US005183349A

United States Patent [19]

Kamen

[11] Patent Number: 5,183,349

[45] Date of Patent: Feb. 2, 1993

[54] LIPSTICK DISPENSER FORMED WITH LIPSTICK FORMULATION

[75] Inventor: Melvin E. Kamen, Highlands, N.J.

[73] Assignee: Revlon Consumer Products Corporation, New York, N.Y.

[21] Appl. No.: 613,036

[22] Filed: Nov. 15, 1990

[51] Int. Cl.[5] ..... A45D 40/00; A45D 40/18; A45D 40/20

[52] U.S. Cl. ..... 401/88; 401/35; 401/96; 401/194; 401/68

[58] Field of Search ..... 401/35, 58, 68, 88, 401/192, 194, 96

[56] References Cited

U.S. PATENT DOCUMENTS 2,344,060 3/1944 Ray .
2,595,403 5/1952 Neuschaefer .
2,858,937 11/1958 Hoffman .
3,192,933 7/1965 Prince .
3,279,999 10/1966 Harrison .
3,393,036 7/1968 Euglsang et al. .
3,453,056 7/1969 Motsavage et al. .
3,706,354 12/1972 Gruska .
3,709,618 1/1973 Gruska .
3,990,577 11/1978 Delia .
4,291,018 9/1981 Oeda .
4,298,036 11/1981 Horvath .
4,740,097 4/1988 Kapustin .
4,813,801 3/1989 Cardia .

FOREIGN PATENT DOCUMENTS 50749 11/1975 Japan .
135377 11/1975 Japan .

*Primary Examiner*—Steven A. Bratlie
*Attorney, Agent, or Firm*—Julie Blackburn

[57] ABSTRACT

A colorized, protective lipstick dispenser for dispensing a lipstick bullet.

5 Claims, 1 Drawing Sheet

LIPSTICK DISPENSER FORMED WITH LIPSTICK FORMULATION

FIELD OF THE INVENTION

This invention relates to improved lipstick products, in general. More particularly, this invention relates to an improved lipstick dispenser and to a method for making same.

BACKGROUND OF THE INVENTION

As is well known, a very important aspect of the cosmetic industry is the preparation and distribution of color-imparting products such as lipsticks. Lipsticks, like numerous other cosmetic products, are relatively soft and somewhat fragile. The marking core of the completed lipstick or "lipstick bullet", as it is known throughout the industry, is inserted into a cup. The cup is usually retractably mounted within the lipstick case. With respect to the overall length of the lipstick bullet, conventional lipstick cups are relatively short and, accordingly, do not protect the exposed useable portion of the lipstick bullet.

It has been proposed in Ray U.S. Pat. No. 2,344,060 to protect the exposed portion of a lipstick bullet with an outer sheath, which circumferentially surrounds the bullet. One end of the sheath is affixed to a casing, while the other end of the sheath is shaped such that lipstick can be extruded therethrough and applied to the lips of the user. Because the sheath is made from either a translucent or transparent plastic or from metal, it is incapable of functioning as a color indicator. Also, due to its relatively hard or rigid construction, the sheath could scratch the lips of the user or otherwise provide an uncomfortable "feel" to the user.

SUMMARY OF THE INVENTION

The problems and disadvantages associated with the prior art to lipstick dispensers adapted to circumferentially encase a lipstick bullet are overcome in accordance with the present invention by making such a dispenser from a composition which includes a given quantity of the actual formulation of the lipstick product and a quantity of a thermoplastic copolymeric strengthening agent. The quantity of the lipstick formulation is sufficient to reflect the true color of the actual lipstick product. Accordingly, the present invention offers a colorized and soft, protective lipstick dispenser.

The method by which the lipstick dispensers disclosed herein are prepared involves a non-complicated and relatively inexpensive procedure. Furthermore, the method for preparing the lipstick dispensers of this invention merely requires admixing the two basic components, under agitation and heat; molding the molten composition into a desired lipstick dispenser configuration; and cooling the resultant molded configuration.

The lipstick dispensers made in accordance with the present invention provide an excellent color indicating means, as well as protection for the lipstick bullet. The novel combination of the lipstick having a given color formulation and the thermoplastic, polymeric strengthening agent can provide a wide range of molded, colorized lipstick dispensers which display the same coloration as the lipstick products with which they are to be associated. Furthermore, as a result of their ability to replicate the exact same color as that of the lipstick product associated therewith, the lipstick dispensers made in accordance with the present invention are disguised, giving the impression that a full, useable lipstick is always present.

BRIEF DESCRIPTION OF THE DRAWINGS

For a better understanding of the present invention, reference is made to the following detailed description of various exemplary embodiments considered in conjunction with the accompanying drawings, in which.

DETAILED DESCRIPTION OF THE DRAWINGS

Figure 1:
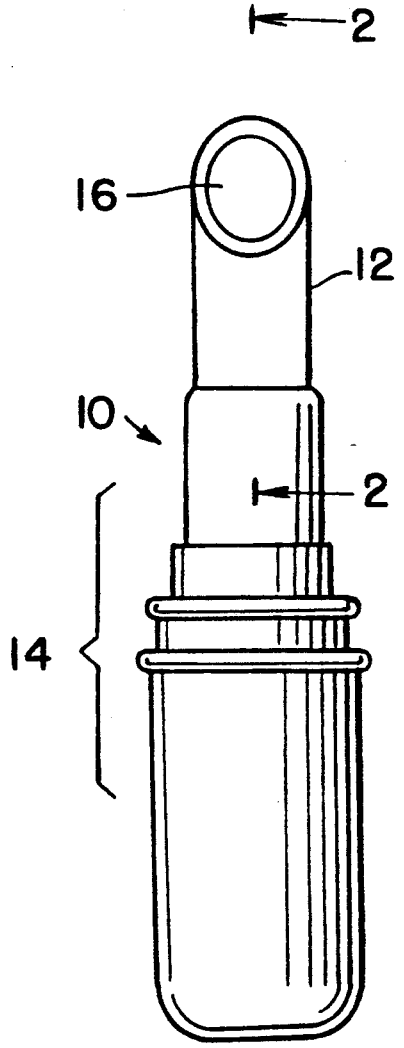
FIG. 1 is an elevational view of a lipstick product which includes a lipstick dispenser constructed in accordance with the present invention.
Figure 2:
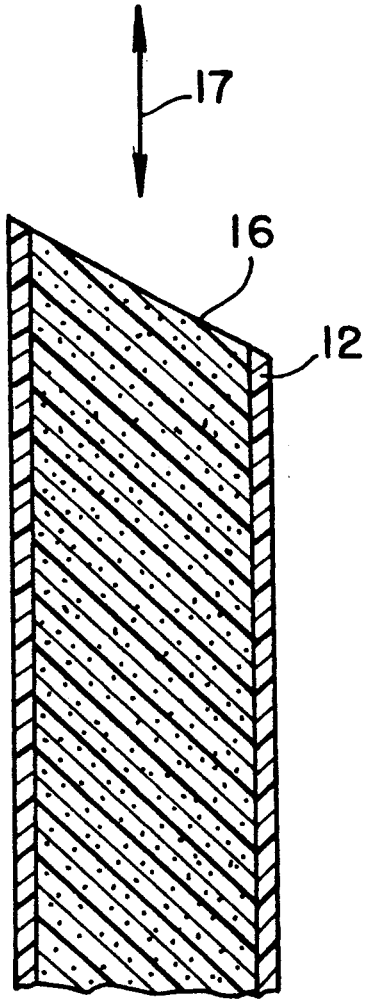
FIG. 2 is an enlarged cross-sectional view, taken along Section line II—II in FIG. 1 and looking in the direction of the arrows, of the lipstick dispenser illustrated in FIG. 1.

Referring to FIGS. 1 and 2, a lipstick product 10 includes a colorized, protective lipstick dispenser 12, a lipstick case 14 and a lipstick bullet 16. In the context and spirit of this invention, the dispenser 12 refers to the homogenous molded composition which circumferentially encases the lipstick bullet 16. One end of the dispenser 12 is non-rotatably affixed to a first end of the lipstick case 14. The other end of the lipstick dispenser 12 is shaped such that the lipstick bullet 16 can be applied to the lips of a user. The dispenser 12 circumferentially encases the lipstick bullet 16, which is movable relative to the dispenser 12 in the direction indicated by arrow 17.

The lipstick case 14 contains a dispensing mechanism, which functions to provide the desired relative motion between the lipstick bullet 16 and the dispenser 12. The primary function of the dispensing mechanism is to eject the lipstick bullet 16 from the lipstick dispenser 12. However, the dispensing mechanism can also function to retract the lipstick bullet 16 back into the dispenser 12. The latter function is useful if the user dispenses an excessive amount of lipstick (i.e., overextends the lipstick bullet 16) from the lipstick dispenser 12. One such dispensing mechanism, which is disclosed in Ray U.S. Pat. No. 2,344,060 and is incorporated herein by reference, includes a piston, which is adapted to slide within a body and which is moved within the body by a thumbscrew. Another such dispensing mechanism is the push-type mechanism disclosed in Horvath U.S. Pat. No. 4,298,036, in which a plunger is slidably received at one end of a body. As the plunger is depressed into the body, it would force a lipstick bullet towards the open end of the body, enabling the lipstick to be dispensed.

The present invention employs a quantity of the actual formulation of a given lipstick product, having a given color formulation, in combination with a thermoplastic ethylene and vinyl-type copolymeric strengthening agent to produce a lipstick dispenser 12 having the same color as that of the aforesaid given lipstick product. The foregoing ingredients, in prescribed ratios, are slowly admixed at a controlled temperature to produce a homogeneous, moldable composition. Accordingly, it is imperative that the thermoplastic strengthening agent be compatible with the cosmetic product composition and be capable of being melted within a temperature range in which the various lipstick components, such as fragrances, pigments, etc., product, will not thermally decompose.

The method for preparing the colorized, protective lipstick dispensers according to the present invention involves the following procedural steps: combining a quantity of the formulation of a lipstick having a given color formulation and the thermoplastic, copolymeric strengthening agent; stirring and heating the mixture until all of the ingredients melt; molding the resultant homogeneous molten mixture into a desired configuration; and cooling the thusly molded lipstick dispenser. Consistent with this procedure, a typical colorized, protective lipstick dispenser can be produced by admixing about 50 parts, by weight, of the formulation of a conventional lipstick having a given color formulation with about 50 parts, by weight, of an ethylene vinylacetate copolymer; heating the mixture to about 95¼ C. or to the temperature at which all of the components become fluid; pouring the resultant melt into a suitable lipstick dispenser mold; and thereafter, cooling the molded configuration by suitable means such as a "chilling table".

Regarding the ratios of the two ingredients utilized in the practice of this invention, the quantity of the formulation of the lipstick product can range from about 5 to about 50 percent, by weight, of the total composition. The quantity of the thermoplastic copolymer strengthening agent can range from about 50 to about 95 percent, by weight, of the total composition.

Regarding the molding step, in the practice of this invention, any suitable conventional means can be utilized to obtain a desired lipstick dispenser configuration. For example, the molding step can be carried out by merely pouring the melt into a mold or by means of either injection molding or extrusion. An example of a suitable mold would be that shaped like a conventional lipstick and having a solid core positioned therein so as to form an annular space defining the desired dimensions of the lipstick dispenser molded therein.

Upon removal from the mold, the lipstick dispenser 12 is affixed by suitable means such as a thermoplastic adhesive to the lipstick case 14 prior to the insertion therein of the lipstick bullet. The dispenser displays the exact same color as that of the lipstick bullet with which it is associated.

Regarding the means by which the lipstick dispensers of this invention are affixed to the lipstick cases, any suitable adhesive can be utilized. For example, conventional thermally curable compositions such as thermosetting materials or thermoplastic materials are readily useful to secure the present novel dispensers to the lipstick cases.

As mentioned hereinabove, the vinyl copolymers useful in the practice of this invention must have a melting point not in excess of that at which the fragrance material, pigment component(s) and any other thermally sensitive ingredients in the lipstick formulation would decompose. In addition to meeting the requirements of compatibility with the various components comprising the lipstick composition, the particular thermoplastic, polymeric material can be selected on the basis of the ring and ball test, i.e. softening point of the mono-substituted vinyl comonomer content, and the melt index thereof.

Among the thermoplastic materials that are useful as strengthening agents in the practice of the present invention are those polymers, copolymers, and terpolymers of which the monomeric portions thereof are characterized by the presence of the ethylenically unsaturated group, and which meet the formulation compatibility and the thermal property requirements discussed hereinabove. Particularly useful materials are the vinyl-type polymers such as polyolefins derived from monomers having from 2 to 6 carbons, the copolymers formed with ethylene and a mono-substituted vinyl comonomer. Examples of such comonomers include vinyl acetate, methylmethacrylate, ethylene glycol dimethacrylate, and polyethylene vinyl alcohol. Additional useful materials include polyurethane, polyethylene, atactic polypropylene, and acrylonitrile-butadiene-styrene. Such useful materials must, of course, meet the formulation compatibility and the thermal property requirements discussed hereinabove.

Various standard test methods suitable for evaluating the rheological properties of the thermoplastic, polymeric strengthening agents within the practice of this invention include those such as, inter alia, a softening point and melt index test as mentioned hereinabove, as well as those of melt elasticity, and shear response. Included among these standard test methods is the test for determining the Melt Flow Rate of the particular resin based on ASTM D1238. The foregoing test method essentially involves placing a prescribed amount of the test resin, i.e. thermoplastic material, into a cylinder which is provided with a plunger and a means of heating the test resin and then measuring the amount of melted test material, in grams, which drops over a ten minute period. The numerical value reflective of the respective melt index is then determined by correlating the equivalent value of the Melt Flow Index. An additional test useful in evaluating the suitability of a thermoplastic material for use in the practice of the present invention is designed to obtain softening point values in degrees Fahrenheit. The last-mentioned test method is a standard method identified as ASTM E28.

The following examples further illustrate certain aspects of the present invention and are not intended to limit the scope thereof.

EXAMPLE I

A series of colorized, protective lipstick dispensers were prepared in accordance with this invention. A conventional, hydrocarbonous-based lipstick formulation and a standard technique for the preparation thereof were utilized to form the moldable pomade to which proportionate amounts of the thermoplastic, polymeric strengthening agent, consistent with the present invention, were added. The base lipstick formulation essentially comprised about 65 percent, by weight, of mineral oil, about 20 percent, by weight, of candelilla wax, 5 percent, by weight, of a fatty material, about 5 percent, by weight, of a polyhydroxyalcohol, and about 5 percent of a color additive.

The above-described components were admixed, under slow agitation and heating, in a jacketed kettle provided with both agitation and heating means, to insure thorough melting and blending. Upon completion of melting and blending, a conventional perfume was added to the melt, as agitation continued, at about 70½ Centigrade. Thereafter, the temperature was adjusted and maintained between 90½ and 110½ Centigrade, as a prescribed amount of an ethylene vinylacetate (EVA) copolymeric hardening agent was stirred into the melt contents of the kettle. The amount of the EVA utilized was approximately 50 percent, by weight, of that of the total of the original melt blend.

Quantities of the above-described hot, modified lipstick pomade were then utilized to prepare colorized, protective lipstick dispensers as described hereinabove, using suitable molds. Subsequent to being cooled on a "chilling table", the thusly formed dispensers were removed from the molds and fixedly attached to cases. Thereafter, molded lipstick bullets, having the same color formulation therein and prepared by means of a conventional, automatic molding method, were inserted into the dispensers.

Upon close inspection, it was observed that the coloration of the above-described dispenser was exactly the same as that of the lipstick bullets associated therewith. It was further observed that the surfaces of the thusly prepared dispensers were uniformly smooth. The dispensers were subsequently evaluated on the basis of their structural integrity. Accordingly, it was determined that the dispensers also possessed the desired characteristics of outstanding overall uniformity, and softness.

EXAMPLE II

An additional quantity of moldable lipstick pomade similar to that prepared in Example I was utilized to fabricate a number of dispensers, in accordance with this invention. The procedural steps outlined in Example I were repeated, except that polyethylene was utilized as the polymeric strengthening agent. The resultant lipstick dispensers exhibited outstanding coloration and structural properties comparable to those of the dispensers in Example I, described hereinabove.

EXAMPLE III

A yet further quantity of moldable lipstick pomade similar to that described in Example I was prepared for the fabrication of an additional number of lipstick dispensers according to this invention. In this instance, polypropylene was substituted for the EVA as the polymeric strengthening agent. The lipstick dispensers obtained herein were comparable, in all respects, to those in the foregoing examples.

Summarizing, the colorized, protective lipstick dispensers prepared in accordance with this invention and exemplified in Examples I–III, supra, are characterized by their excellent color-indicating capability. They are capable of exhibiting the same color of the lipsticks with which they are respectively associated. Furthermore, the novel lipstick dispenser disclosed herein is relatively soft, and does not yield a payoff; yet it possesses outstanding structural integrity.

Based on the disclosure set forth hereinabove, it will be understood that the embodiments described herein are merely exemplary. It will become apparent to those skilled in the art that various modifications in procedures, proportions, and materials may be made, without departing from the spirit and scope of the invention. All such modifications and variations are intended to be included within the scope of the invention, as defined by the following claims.

What is claimed is:

1. In combination, a lipstick bullet comprising a lipstick formulation suitable for application to the lips; and a dispenser sized and shaped so as to circumferentially encase said lipstick bullet; said dispenser comprising 5–50% lipstick formulation and 50–95% thermoplastic copolymer hardening agent wherein the color of said dispenser replicates the color of said lipstick bullet which is moveable relative to the dispenser such that the lipstick bullet can be ejected and retracted from the dispenser.

2. The lipstick dispenser of claim 1 comprising about 25 to about 50 percent lipstick formulation, and about 50 to about 75 percent thermoplastic copolymer hardening agent.

3. The lipstick dispenser of claim 2, wherein said thermoplastic copolymer hardening agent is ethylene vinylacetate.

4. The lipstick dispenser of claim 1, wherein said thermoplastic copolymer hardening agent is polyethylene.

5. The lipstick dispenser of claim 1 wherein said thermoplastic copolymer hardening agent is an atactic polypropylene.

* * * * *